US005752344A

United States Patent [19]

Richmond

[11] Patent Number: 5,752,344

[45] Date of Patent: May 19, 1998

[54] SWING GATE OPERATOR

[75] Inventor: Moscow K. Richmond, Inglewood, Calif.

[73] Assignee: Doorking Inc., Inglewood, Calif.

[21] Appl. No.: 808,838

[22] Filed: Feb. 28, 1997

[51] Int. Cl.[6] ..... E05F 11/24

[52] U.S. Cl. ..... 49/340; 49/339

[58] Field of Search ..... 49/339, 340, 341, 49/345, 138

[56] References Cited

U.S. PATENT DOCUMENTS

| | | | |
|---|---|---|---|
| 4,330,958 | 5/1982 | Richmond | 49/340 X |
| 4,403,449 | 9/1983 | Richmond | 49/340 |
| 4,429,264 | 1/1984 | Richmond | 49/340 X |
| 5,557,825 | 9/1996 | Harr | 49/345 X |

FOREIGN PATENT DOCUMENTS

| | | | |
|---|---|---|---|
| 2418856 | 11/1979 | France | 49/340 |
| 3615200 | 11/1987 | Germany | 49/340 |

*Primary Examiner*—Jerry Redman

*Attorney, Agent, or Firm*—Robert J. Schaap

[57] ABSTRACT

A gate opening and closing apparatus, typically referred to as a "gate operator" and which automatically moves a gate, such as a swinging gate between opened and closed positions. The gate operator of the invention employs a power unit, such as an electrically motor driven power unit which rotates a power arm. A crank arm is releasably connected to the power arm and movable therewith. In addition, the crank arm is, in turn, connected to a connecting arm which has one end connected to the gate for movement of the gate. The invention relies upon the use of a swing movement control mechanism in place of stop rings which were previously used to control the limits of movement of the gate. The swing movement control mechanism comprises a swing movement control plate shiftable along the crank arm so that the connecting arm which is also pivoted on the swing movement control plate can be connected to a gate having a desired swing or so-called "throw". The swing movement control mechanism includes an upstanding toggle which controls limit of movement of the connecting arm and also includes a pair of downwardly projecting flanges which also limits the movement of the connecting arm.

20 Claims, 5 Drawing Sheets

SWING GATE OPERATOR

BACKGROUND OF THE INVENTION

1. Field of the Invention

This invention relates in general to certain new and useful improvements in gate operators for controlling the opening and closing movements of a gate, and more particularly to an improved gate operator which controls the movements of a swinging gate and allows for adjustment of the operating mechanism so that it can be easily and conveniently used with differing sized gates.

2. Brief Description of the Prior Art

Over the years, a variety of types and styles of gates have been developed to provide security for enclosed areas, frequently referred to as "secured areas", such as parking structures and gated residential and industrial properties. The gates which control the access openings may adopt the form of sliding gates which move linearly in a trackway or otherwise, swinging gates which are rotatably hinged to a fixed structure. In the case of large passageways, gates may be provided in pairs which operate from opposite sides of the openings.

The prior art has disclosed a large number of actuating mechanisms in gate operators for connecting the gate to a power unit. Typically, the power unit adopts the form of an electrical drive motor or other form of drive motor. Moreover, the actuating mechanism includes one or more arms connected from the power unit to the gate to cause swinging movement of the gate. One such actuating mechanism is more fully illustrated and described in U.S. Pat. No. 4,970,826 dated Nov. 20, 1990 to Richmond et al. In this gate operator, a gate was rotatably moveable about a vertical hinge between open and closed positions by means of a drive arm and a connecting arm arrangement in combination with a coupling and latching arm arrangement. The coupling arm was normally engaged with the drive arm and movable therewith. A latching arm was provided for latching the coupling arm to the drive arm and a connecting mechanism was used for connecting the coupling arm to the gate.

While the mechanism employed in the aforesaid Richmond et al. '826 patent is still effective and in use, it has been found that there is a need for a mechanism which more conveniently and easily allows for the use of a single operator with differing sized gates. As may be appreciated, differing sized access openings will require different sized gates and therefore, the gate operator must be capable of moving that gate through a controlled path, whether or not the gate has a large radius swing or a small radius swing.

There are numerous occasions in which an authorized user of a gate may also desire manual opening and closing movement of the gate, as opposed to automatic opening and closing movement. Generally, with most conventional gate operators, it is necessary to engage in some complex mechanical disengagement of the gate in order to permit manual opening and closing movement of the gate. Thus, and in many cases, need for access to the drive housing for purposes of uncoupling one or more gear drives in the housing is required. Thus, disengaging an automatic drive from the gate operator can be a complex and time consuming procedure. There is a need to be able to easily and conveniently disengage the drive mechanism from the gate so that one can manually open and close the gate easily and against a heavy mechanical disadvantage created by the gear train in the gate operator.

U.S. Pat. No. 4,159,599 dated Jul. 3, 1979 by Moscow K. Richmond for "Gate Opening and Closing Assembly" discloses a gate which is slidable between opened and closed positions and which uses a solenoid operated locking mechanism. U.S. Pat. No. 4,429,264 dated Jan. 31, 1984 by Moscow K. Richmond for "System and Method for the Automatic Control of Electrically Operable Gates" discloses a gate opening and closing mechanism which utilizes automatic control features and which also provides for manual operation. Other gate operators for swinging and sliding gates are disclosed in U.S. Pat. No. 4,313,281 dated Feb. 2, 1982 by Moscow K. Richmond for "Gate Opening and Closing Apparatus and Method", U.S. Pat. No. 4,330,958 dated May 25, 1982 for "Gate Opening and Closing Assembly with Automatic Locking Means" by Moscow K. Richmond.

OBJECTS OF THE INVENTION

It is, therefore, one of the primary objects of the present invention to provide a gate operator for automatically opening and closing a gate which allows for attachment to differing sized gates.

It is another object of the present invention to provide a gate operator of the type stated which permits easy opening and closing movement of a gate and which allows for differing degrees of swing between gate opened and gate closed positions.

It is a further object of the present invention to provide a gate operator of the type stated which uses a toggle bracket arrangement for controlling the limit of movement of a crank arm and hence the movement of the gate in each of an opening movement and a closing movement.

It is an additional object of the present invention to provide a gate operator of the type stated which utilizes a unique coaction between a drive arm and a coupling arm and a latching arm arrangement to permit automatic driving movement of the gate but which is also permits easily accomplished disengagement of one or more of the arms to permit manual opening movement of the gate.

It is also an object of the present invention to provide a gate operator of the type stated which is quiet in operation and which is highly reliable in operation.

It is another salient object of the present invention to provide a gate operator of the type stated which is effective in use and which can be constructed at a relatively low cost.

It is still a further object of the present invention to provide a method of opening and closing a gate which permits automatic controlled movement of the gate between opened and closed positions and which allows for use with differing sized gates and with gates having differing arcs of swing.

With the above and other objects in view, my invention resides in the novel features of form, construction, arrangement and combination of parts presently described and pointed out in the claims.

BRIEF SUMMARY OF THE INVENTION

A gate opening and closing apparatus or so-called "gate operator" for moving a gate between two fixed end positions, which constitute a gate opened position and a gate closed position. The unique gate operator of the invention allows for operation of gates of differing sizes and with differing sized movement paths. Thus, the single gate operator can be used with gates having a short arcuate movement path or a wide arcuate movement path.

The term "gate" is used in a broad sense to encompass any member which extends over an access opening leading into a secured area. Thus, the term "gate" is used in a generic sense to cover doors and the like.

The gate operator of the present invention comprises a powered drive unit which may adopt the form of a power drive unit, such as an electric motor drive and a drive arm driven by that electric motor drive. A crank arm is powered for rotatable movement by the power drive unit. In a preferred embodiment, the crank arm is releasably coupled to the drive arm operable by the drive motor. Thus, the crank arm will rotate with the rotation of the drive arm.

The drive arm is designed to rotate in one direction and to move the gate to an opened position and then in an opposite direction to move the gate to a closed position. The crank arm is powered for rotatable movement by the powered drive arm. Preferably, the crank arm is releasably coupled to the power by the drive arm so that the crank arm can be easily manually disengaged therefrom. For example, a connecting pin extending through the crank arm and the drive arm could be employed in order to enable the crank arm to be manually rotated independently of the drive arm in the event of a power failure.

A connecting arm is operatively connected to the crank arm at one end so that rotatable movement of the crank arm will cause the connecting arm to move the gate in an arcuate swing path between an opened position and a closed position. For this purpose, the connecting arm is pivotally connected at its other end to the gate.

A control system, such as a microprocessor control, would be connected to the powered drive unit for controlling operation of the same. The microprocessor or other control unit would be operable in response to input commands which would be a gate open command, or a gate close command or for that matter, an interrupt command in the event that the gate contacts an obstruction during the path of movement.

One of the principal problems encountered in the installation of a swing gate, such as the type encompassed by the present invention, is the fact that various gates may have different movement paths depending upon the particular installation involved. Moreover, the gate is typically sized to conform to the access opening and thus, one gate may have a different swing or so-called "throw" than another gate. In order to compensate for this problem, the present invention provides a swing movement control mechanism or so-called "swing movement coupling mechanism" which connects the connecting arm and the crank arm. This swing movement control mechanism is positionally locatable on the crank arm or otherwise on the connecting arm so that the length of the connecting arm and the crank arm can accommodate the movement path and the size of the swingable gate.

In order to effectively operate the swing movement coupling mechanism, a toggle effecting means is provided on the swing movement coupling mechanism to limit the rotational movement of the connecting arm with respect to the crank arm. In this way, the overall arcuate length through which the gate moves can be controlled to conform to the size of the access opening.

The swing movement coupling mechanism comprises a plate which is shiftable either on the connecting arm or the crank arm. More preferably, this plate is shiftable on the crank arm and the connecting arm is pivotally coupled to the plate. The connecting arm is preferably pivotally coupled to the plate at a pivot point which is coincident to a pivot axis representing the pivotal connection of the crank arm to the plate.

The toggle action effecting means comprises a first toggle element which controls the amount of movement of the connecting arm with respect to the crank arm in one direction, as for example, when moving the gate to an opened position. This toggle element also controls the movement of the connecting arm in the opposite direction when moving the gate to the closed position.

The toggle action effecting means further comprises a second element, such as a pair of depending elements, which controls the movement of the swing movement coupling mechanism on the crank arm. The first element is an upstanding element and the second element comprises a pair of spaced-apart depending elements which engage opposite sides of the crank arm to control movement of this coupling mechanism.

This invention possesses many other advantages and has other purposes which will be made more clearly apparent from a consideration of the forms in which it may be embodied. These forms are shown in the drawings forming a part of and accompanying the present specification. They will now be described in detail for purposes of illustrating the general principles of the invention, but it is to be understood that such detailed description and the illustrations set forth in the drawings are not to be taken in a limiting sense.

BRIEF DESCRIPTION OF THE DRAWINGS

Figure 1:
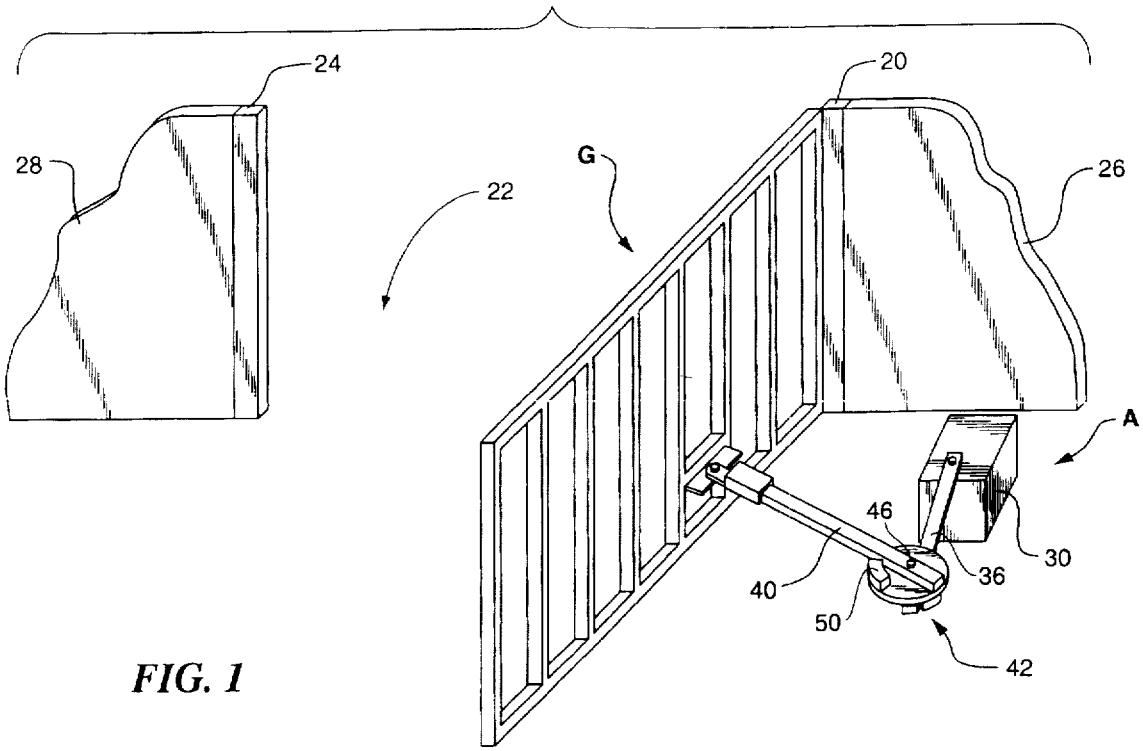
Figure 2:
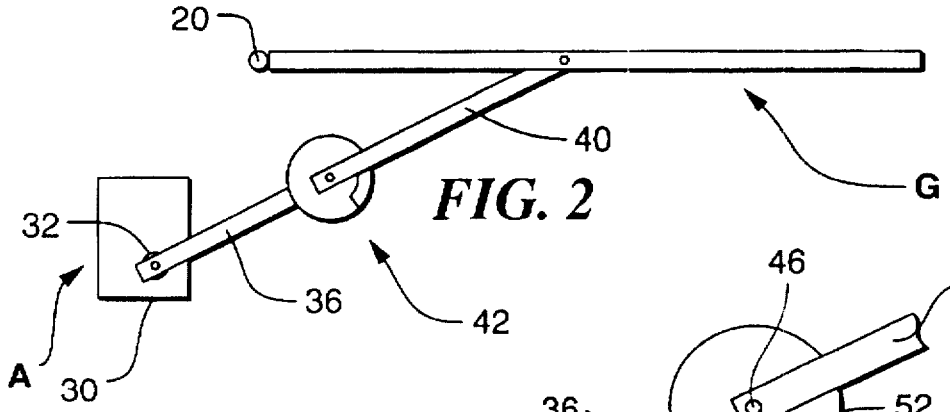
Figure 3:
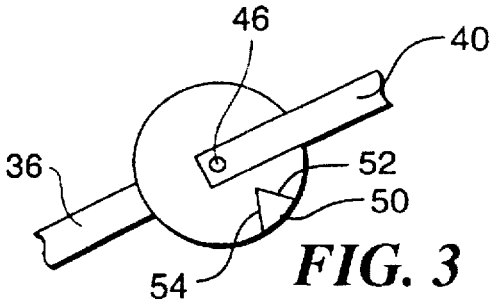
Figure 6:
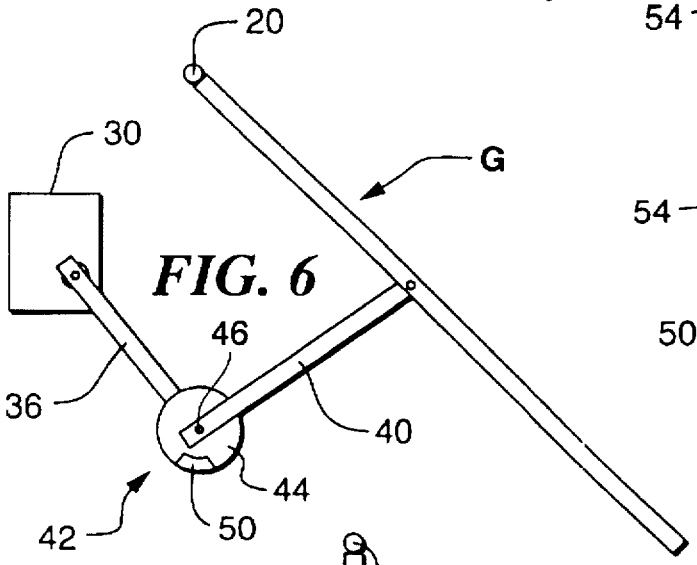
Figure 7:
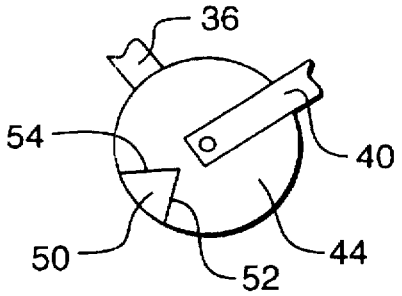
Figure 9:
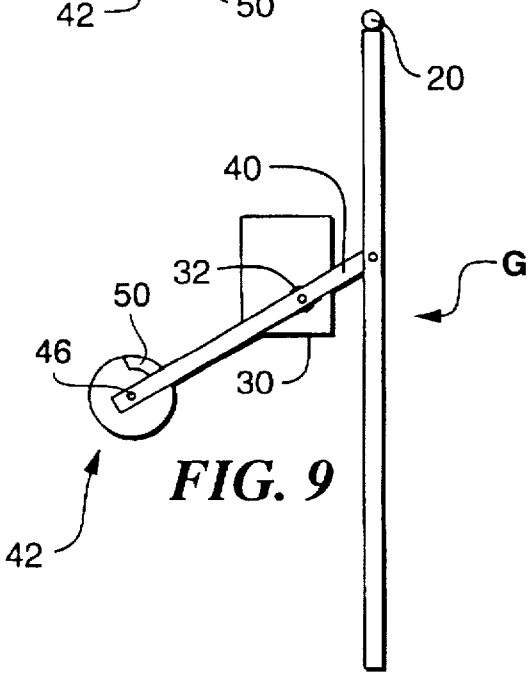
Figure 10:
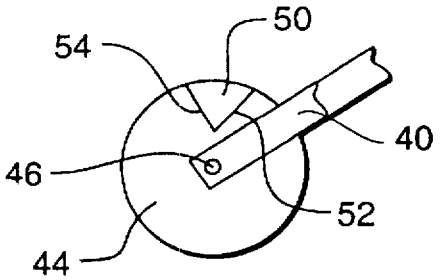
Figure 4:
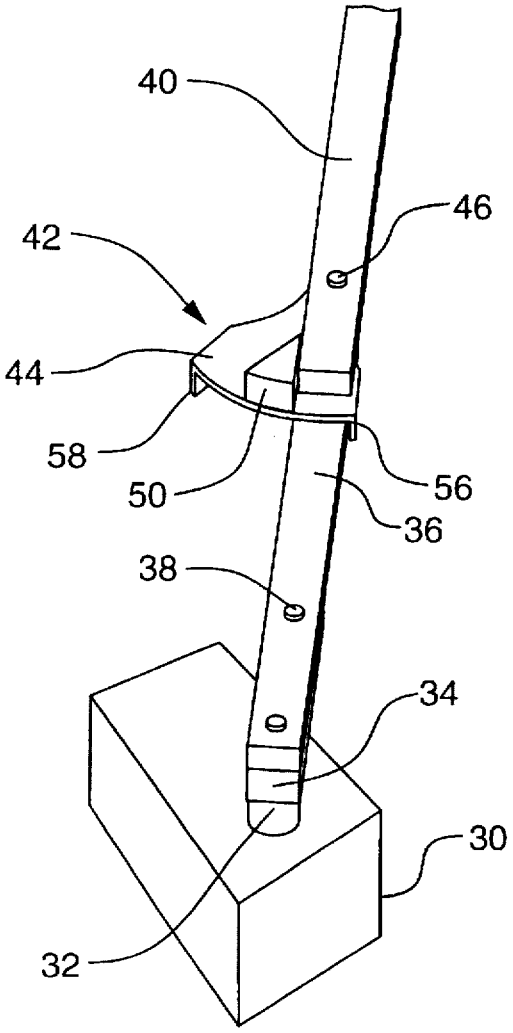
Figure 5:
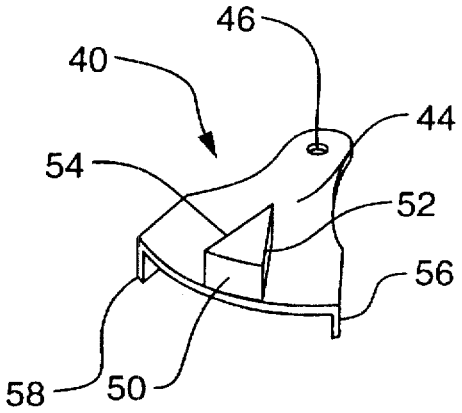
Figure 11:
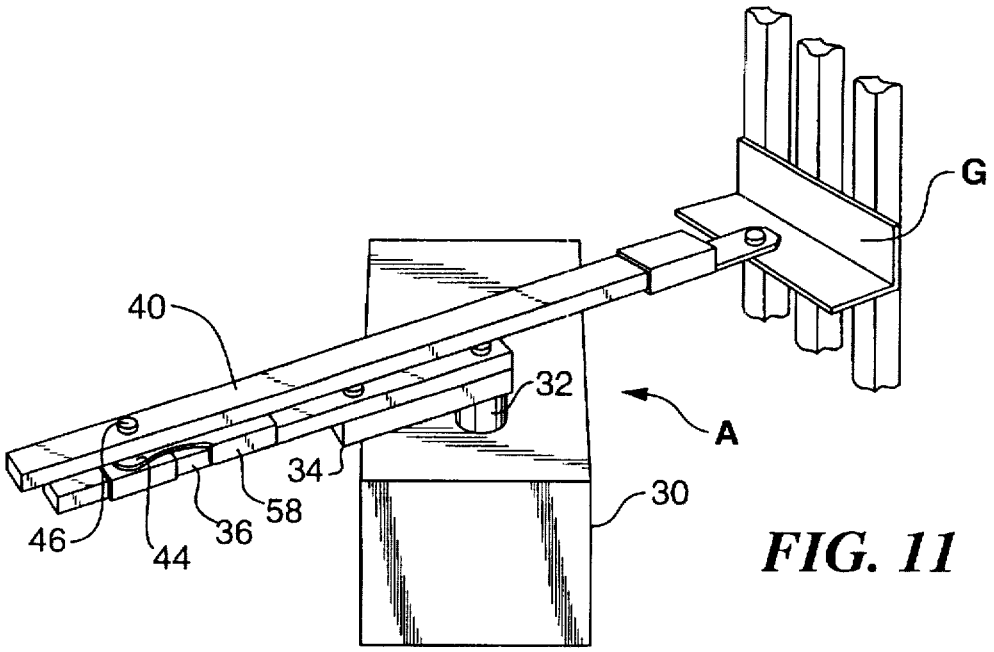
Figure 8:
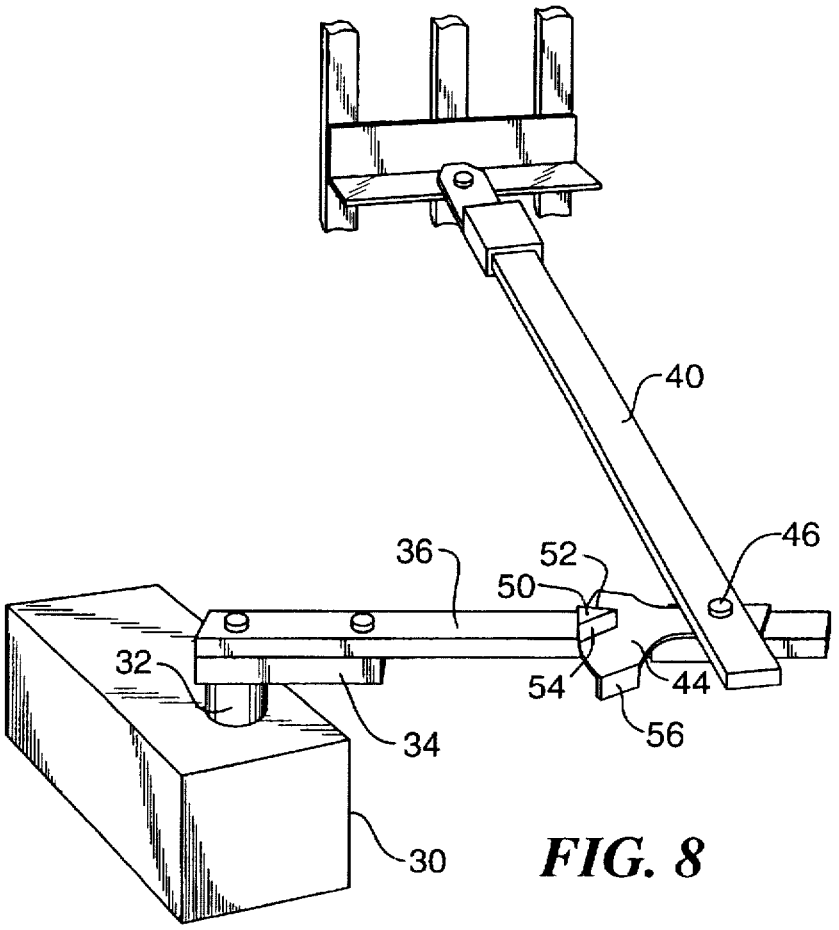
Figure 12:
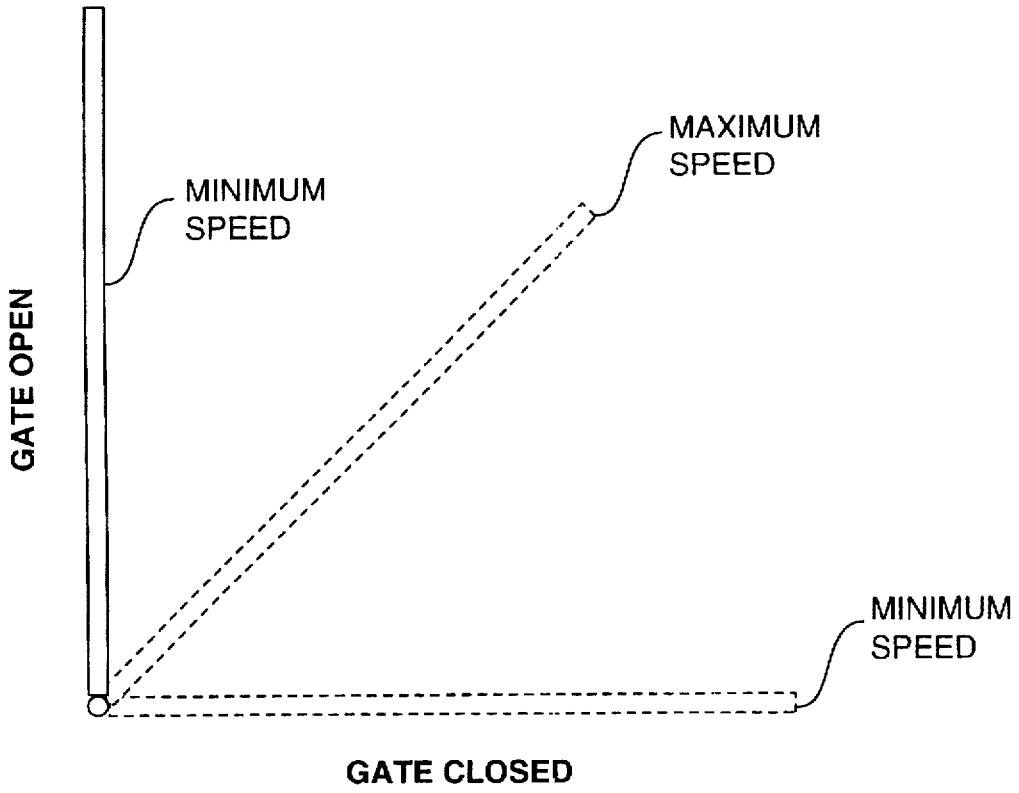
Figure 13:
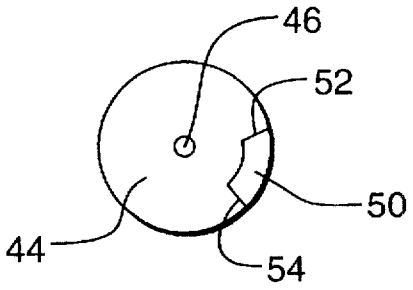

Having thus described the invention in general terms, reference will now be made to the accompanying drawings in which:

FIG. 1 is a perspective view, partially broken away and showing a gate operator of the present invention connected to a swingable gate;

FIG. 2 is a schematic top plan view showing the position of a crank arm and a connecting arm of the gate operator when the gate is in a closed position;

FIG. 3 is an enlarged fragmentary top plan view showing a portion of a swing movement coupling mechanism and the position of the crank arm with respect to the connecting arm when the gate is in the position as shown in FIG. 2;

FIG. 4 is a fragmentary perspective view showing the relative positions of the connecting arm and the crank arm and a driving arm with respect to the swing movement control mechanism of the present invention when the gate is in a closed position;

FIG. 5 is a perspective view of the swing movement control mechanism;

FIG. 6 is a schematic top plan view, similar to FIG. 2, but showing the position of the connecting arm and crank arm when the gate is in a partially opened position;

FIG. 7 is a fragmentary top plan view showing the arrangement of the connecting arm and the crank arm relative to the swing movement control mechanism of FIG. 6;

FIG. 8 is a perspective view showing the position of the crank arm and the connecting arm with respect to the swing movement control mechanism and the drive arm when the gate is in a partially opened position of the type shown in FIG. 6;

FIG. 9 is a schematic top plan view showing the position of the crank arm and the connecting arm forming part of the gate operator when the gate is in a fully opened position;

FIG. 10 is an enlarged schematic fragmentary top plan view showing the arrangement of the swing movement control mechanism relative to the crank arm and the connecting arm when the gate is in the fully opened position, as shown in FIG. 9;

FIG. 11 is a perspective view showing the arrangement of the crank arm and drive arm and the connecting arm when the gate is in a fully opened position, as shown in FIG. 9;

FIG. 12 is a graphical view showing speed relative to the position of the arms in connection with the present invention; and FIG. 13 is a top plan view of a plate forming a part of a modified swing movement control mechanism of the present invention.

DETAILED DESCRIPTION OF PREFERRED EMBODIMENTS

Referring now in more detail and by reference characters to the drawings which illustrate a preferred embodiment of the present invention, A represents a gate operator which is capable of moving a gate G between a gate opened position and a gate closed position.

In the arrangement as shown in FIG. 1, the gate G is hingedly mounted on a post 20 for swinging movement between a gate opened position where the gate is moved away from an access opening 22 to a closed position where it will engage an oppositely disposed fixed post 24. Each of the posts 20 and 24 are respectively secured to the ends of enclosing walls 26 and 28. In effect, any type of enclosure can be used with the gate G. The actual gate itself is neither illustrated nor described in any further detail herein and the mechanism of mounting the gate is neither illustrated nor described in any further detail herein since those details of construction are essentially conventional. For such details, reference is made to U.S. Pat. No. 4,970,826, dated Nov. 20, 1990 to Richmond et al.

The gate operator A of the present invention includes an outer housing 30 which contains a drive motor (not shown) along with a gear drive mechanism and the like. The actual details of the power drive itself is more fully illustrated and described in the aforesaid U.S. Pat. No. 4,970,826, dated Nov. 20, 1990 to Richmond et al. However, the drive mechanism provides an output drive shaft 32 which is capable of rotating in both a clockwise direction and a counter-clockwise direction in response to control signals from a microprocessor controller located within the housing 30.

Secured to and being rotatable by the output drive shaft 32 is a power drive arm 34, as best shown in FIGS. 4 and 8 of the drawings. The drive arm 34 is also rotated in response to rotation of the shaft 32.

Releasably coupled to the power arm or so-called "drive arm" 34 is a crank arm 36. As a result, the crank arm 36 will rotate in both a clockwise and a counter-clockwise directions in response to rotation of the power arm 34.

The crank arm is releasably coupled to the power arm 34 by means of a removable pin 38 which extends through aligned apertures in the power arm 34 and the crank arm 36. In this way, removal of the pin 38 will enable a user to manually open the gate independently of the gate operator A in the event of a power failure or the like. Moreover, by uncoupling the crank arm 36 and the power arm 34 the user will not have to push against the mechanical disadvantage of the gear mechanism in the gate operator A.

The crank arm 36 is connected to one end of a connecting arm 40 and the opposite end of which is pivotally connected directly to the gate G. In this way, rotation of the crank arm 36 will cause rotation of the connecting arm 40 which will, in turn, cause rotatable movement of the gate or so-called "swinging movement" about the hinge axis at the post 20.

The connecting arm 40 is pivotally connected to the crank arm 36 through a swing movement coupling mechanism, the latter of which is best illustrated in FIG. 5 of the drawings. The swing movement coupling mechanism 42 comprises a flat plate 44 which is pivotally coupled to an end of the crank arm 36 at a pivot point 46, as shown in FIGS. 4 and 5. In like manner, the connecting arm 40 has a corresponding end pivotally coupled to the flat plate 44 through the same pivot point 46. This pivot point 46 may adopt the form of a pivot pin which thereby allows the connecting arm 40 to pivot independently with respect to the crank arm 36 and which also allows the flat plate 44 to pivot to a limited degree with respect to the crank arm 36. However, the connecting arm 40, even though rotatably independent of the crank arm 36, is controlled by movement of the crank arm 36 through the swing movement coupling mechanism 42, as hereinafter described.

The swing movement coupling mechanism 42 comprises an upstanding toggle effectuating element 50 which has a pair of angulated flat engagement faces 52 and 54. In the form as illustrated in FIGS. 4, 5 and 8, for example, the toggle effectuating element 50 is triangularly shaped. Moreover, the plate 44 is provided on each of its opposite side edges with a depending limit flanges 56 and 58. The limit flanges 56 and 58 control the pivotal movement of the plate 44 with respect to the crank arm and allow the plate only a very limited degree of movement. The upstanding toggle effectuating element 50, however, allows a path of movement of the connecting arm 40 which is only slightly less than 360°, as for example, 300°–340°.

FIG. 2 shows the position of the connecting arm 40 with respect to the crank arm 36 when the gate is in the fully closed position. It can be seen that the connecting arm 40 and the crank arm 36 are generally aligned and create a positive locking action to preclude someone from attempting to push the gate to an opened position or a partially opened position.

FIG. 3 shows the position of the connecting arm 40 relative to the toggle effectuating element 50 when the gate is in the fully closed position. It can be seen that the connecting arm 40 has abutted against the face 52 of the toggle effectuating element 50. This same action is effectively shown in FIG. 4. Moreover, it can be observed that the limit flange 56 has also engaged the crank arm 36 thereby limiting the movement of the swing movement coupling mechanism 42.

FIG. 6 shows the position of the crank arm 36 and the connecting arm 40 when the gate G is in a fully opened position. In this case, it can be seen that there is an angular relationship between the connecting arm 40 and the crank arm 36. Moreover, the connecting arm 40 has not abutted against any face of the upstanding toggle effectuating element 50. The actual position of the connecting arm relative to the upstanding toggle effectuating element 50 is also more fully illustrated in FIG. 7 of the drawings.

FIG. 9 shows the position of the connecting arm 40 and the crank arm 36 when the gate G has been moved to a fully opened position. Moreover, it can be observed that the swing movement coupling mechanism 42 has been shifted to a position on the opposite side of the housing 30 with respect to the position of this mechanism when the gate was in the fully closed position.

FIG. 11 also illustrates the position of the various arms, such as the drive arm 34, the crank arm 36 and the connecting arm 40 when the gate G has been moved to the fully opened position. It can be observed that the movement of the crank arm 36 and also the movement of the swing movement coupling mechanism 42 is limited by engagement of the flange 58 with the crank arm 36.

It can be seen that this swing movement coupling mechanism 42 effectively limits the movement of two arms, namely the crank arm 36 and the connecting arm 40. Moreover, it allows a harmonic motion of the connecting arm 40. In effect, the gate now starts a movement at a slow rate of speed and increases its rate of speed until it reaches a midpoint between the fully opened and the fully closed positions. At this point, the speed then begins to reduce to a minimum speed again at the fully opened position. This speed chart is more fully illustrated in FIG. 12 of the drawings. It can be seen that a minimum speed is obtained when the gate is at the fully closed position and also at the fully opened position. Moreover, a maximum speed is obtained when the gate is at a position intermediate these end positions. The speed algebraically decreases from the maximum speed to the minimum speed positions as the gate moves toward the fully opened or closed position.

It is also now possible to eliminate the stop rings which were previously employed in gate operators and which had to be set by the installer at each particular installation. Moreover, from time to time, the stop rings had to be adjusted. It is now possible to achieve the same result using the swing movement coupling mechanism of the invention.

The limit flanges 56 and 58 also allow for some tolerance to insure that the gate has reached the fully closed position or otherwise the fully opened position. The upstanding toggle effectuating element 50 will allow for the use of different sized crank throws for different sized gates. For a smaller gate, with a shorter degree of movement, the plate 44 is merely shifted along the crank arm 36 toward the power arm 34.

FIG. 13 illustrates a slightly modified form of swing movement control mechanism using a modified upstanding toggle effectuating element 50'. In this case, it can be seen that the toggle effectuating element 50' is somewhat elongate arcuately shaped but nevertheless provides the opposed engagement faces 50 and 52.

Thus, there has been illustrated and described a unique and novel swing gate operator which enables use with a variety of differently sized gates and with different throw paths. The present invention thereby fulfills all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by letters patent is:

1. A gate operator moving a gate between two fixed end positions constituting a gate opened position and gate closed position and which allows for operation of differently sized gates and with different sized movement paths with said gate operator, said gate operator comprising:

a) a powered drive unit;

b) a crank arm powered for rotatable movement by said powered drive unit;

c) a connecting arm connected to the gate and to said crank arm so that the rotatable movement of the crank arm will cause the connecting arm to move the gate in an arcuate swing path between an opened position and a closed position;

d) a swing movement coupling mechanism connecting the connecting arm to the crank arm, said swing movement coupling mechanism being positionally locatable on said crank arm so that the connecting arm and the crank arm have a length which can accommodate the movement path and size of a gate; and e) toggle effectuating means on said swing movement coupling mechanism to limit the rotatable movement of the connecting arm with respect to the crank arm.

2. The gate operator of claim 1 further characterized in that said swing movement coupling mechanism comprises a plate which is pivotally connected to said crank arm and said connecting arm is pivotally connected to said plate.

3. The gate operator of claim 2 further characterized in that the connecting arm is pivotally connected to the plate at a pivot axis which is coincident to a pivot axis representing the pivotal connection of the plate to the crank arm.

4. The gate operator of claim 2 further characterized in that said toggle action effectuating means comprises a first toggle element which controls movement of the connecting arm in one direction when moving the gate to the opened position and in the opposite direction when moving the gate to the closed position.

5. The gate operator of claim 4 further characterized in that said toggle action effectuating means comprises a second element which controls movement of the swing movement coupling mechanism on the crank arm.

6. The gate operator of claim 5 further characterized in that the first element is an upstanding element and the second element comprises a pair of spaced apart depending elements which engage opposite sides of the crank arm to control movement of the coupling mechanism.

7. The gate operator of claim 1 further characterized in that said drive unit comprises a drive arm and a drive motor and the crank arm is coupled to the drive arm.

8. The gate operator of claim 7 further characterized in that the drive arm is coupled to the crank arm by a movable member.

9. A gate operator moving a gate between two fixed end positions constituting a gate opened position and a gate closed position and which allows for operation of differently sized gates and with different sized movement paths with said operator, said gate operator comprising:

a) a powered drive unit;

b) a crank arm connected to said drive unit and powered for rotational movement by said drive unit;

c) a connecting arm pivotally connected to said crank arm and being movable thereby between said two fixed end positions and where one of said fixed end positions constitutes the gate opened position and the other fixed end position constitutes the gate closed position;

d) connecting means for connecting the connecting arm to the gate and which connecting arm is moved by the crank arm to thereby cause movement of the gate; and e) a swing movement coupling means connecting said connecting arm to said crank arm, said coupling means having a projecting toggle element providing a toggle action so that at one end position the rotational movement of the connecting arm is limited by engagement therewith and rotational movement of the connecting arm is also limited by engagement therewith at the other end position.

10. The gate operator of claim 9 further characterized in that a powered drive arm is powered for rotation by said powered drive unit and said crank arm is connected to said drive arm.

11. The gate operator of claim 9 further characterized in that the coupling means is positionally locatable between said crank arm and said connecting arm to control an overall length of both of said coupled arms.

12. The gate operator of claim 9 further characterized in that said coupling means comprises a plate which is pivotally connected to said crank arm and said connecting arm is pivotally connected to said plate.

13. The gate operator of claim 12 further characterized in that the connecting arm is pivotally connected to the plate at a pivot axis which is coincident to a pivot axis representing the pivotal connection of the plate to the crank arm.

14. The gate operator of claim 12 further characterized in that said coupling means comprises a first toggle element which controls movement of the connecting arm in one direction when moving the gate to the opened position and in the opposite direction when moving the gate to the closed position.

15. The gate operator of claim 14 further characterized in that said toggle action effectuating means comprises a second element which controls movement of the swing movement coupling means on the crank arm.

16. A gate operator having a rotatable driving member and a connecting arm pivotally connected to said driving member and a swingable gate movable between open end and closed end positions in response to rotatable movement of said connecting arm, an improvement comprising a coupling means which allows control over the movement of the connecting arm with respect to the driving member, said coupling means being comprised of:

a) a plate means with means for pivotally mounting the driving member and the connecting arm;

b) pivot means for pivotally mounting the driving member and pivotally mounting the connecting arm to the plate means;

c) toggle action effecting means on said plate means providing a toggle action so that at one end position rotational movement of the connecting arm is limited by engagement therewith and rotational movement of the connecting arm is also limited by engagement therewith at the other end position.

17. The improvement in the coupling means of claim 16 further characterized in that the pivot means pivotally mounts the driving member and the connecting arm to the plate means about the same rotational axis.

18. The improvement in the coupling means of claim 17 further characterized in that said toggle action effectuating means comprises a first toggle element which controls movement of the connecting arm in one direction when moving the gate to an opened end position and in the opposite direction when moving the gate to the closed end position.

19. The improvement in the coupling means of claim 18 further characterized in that said toggle action effectuating means comprises a second element which controls movement of the coupling plate on the crank arm.

20. The improvement in the coupling means of claim 19 further characterized in that the first element is an upstanding element and the second element comprises a pair of spaced apart depending elements which engage opposite sides of the crank arm to control movement of the coupling means.

* * * * *